United States Patent [19]

Friedenthal

[11] Patent Number: 4,781,125

[45] Date of Patent: Nov. 1, 1988

[54] DROP BOTTOM TRUCKS OR HOPPERS

[75] Inventor: Reginald Friedenthal, Johannesburg, South Africa

[73] Assignee: Standcar (Proprietary) Limited, Johannesburg, South Africa

[21] Appl. No.: 926,726

[22] Filed: Nov. 4, 1986

[30] Foreign Application Priority Data

Nov. 5, 1985 [ZA] South Africa ..... 85/8477

[51] Int. Cl.[4] ..... B61D 7/02

[52] U.S. Cl. ..... 105/250; 414/388

[58] Field of Search ..... 105/250, 288, 289; 414/383, 387, 388

[56] References Cited

U.S. PATENT DOCUMENTS

| | | | |
|---|---|---|---|
| 1,266,630 | 5/1918 | Ross et al. | 414/387 |
| 1,294,876 | 2/1919 | Chnapko | 414/388 |
| 1,333,947 | 3/1920 | Travell | 414/387 |
| 1,378,574 | 5/1921 | Weston | 414/383 |
| 1,418,722 | 6/1922 | Leu | 105/250 |
| 2,686,479 | 8/1954 | Shields et al. | 105/286 |
| 3,452,886 | 7/1969 | Dorey | 414/388 |
| 3,765,341 | 10/1973 | Ried | 414/388 |
| 4,244,299 | 1/1981 | Peterson | 414/388 |
| 4,262,601 | 4/1981 | Miller | 414/388 |
| 4,278,382 | 7/1981 | Knippel | 414/388 |
| 4,339,222 | 7/1982 | Knippel | 414/387 |

FOREIGN PATENT DOCUMENTS

85/7110 9/1985 South Africa .

*Primary Examiner*—Joseph F. Peters, Jr.
*Assistant Examiner*—Thomas J. Brahan
*Attorney, Agent, or Firm*—Mason, Fenwick & Lawrence

[57] ABSTRACT

This invention relates to a hopper, and more particularly to a wheeled hopper for rail operation, including a container body which has a discharge opening in its underside, two doors which are pivotally connected to the body on opposite sides of its discharge opening with the pivot axes of the doors lying in the direction of travel of the hopper, the doors being movable between a first position in which they close the opening and a second position in which the opening is open, a door latch arrangement including an abutment formation on each door at one end of the hopper which, in the first position of the doors, are opposite and directed towards each other at a position above the pivot axes of the doors, a detent between the abutments for preventing movement of the doors from their first to second positions and means on the hopper body which is movable independently of the doors for moving the detent from between the abutments to enable the doors to move under gravity from their first to their second position.

8 Claims, 3 Drawing Sheets

DROP BOTTOM TRUCKS OR HOPPERS

FIELD OF THE INVENTION

This invention relates to side and bottom discharge rail hoppers and more particularly to such hoppers for use in conveying ore bearing rock and like particulate material in underground mines.

BACKGROUND TO THE INVENTION

Side and bottom discharge mine hoppers are well known. The hoppers generally consist of a hopper body which is mounted on a wheeled frame or chassis and include one or more doors for opening and closing an opening at the base of the side wall or walls or in the base of the hopper body. The hopper doors are more often than not held in their closed position by latches which consist of a hook shaped movable part which is engaged with a fixed catch. The latches, in automatic discharge applications, are released by mechanisms on the hoppers which, at the tip at which the hoppers are to be discharged, are activated by some fixed structure at the side of the tip. Examples of latch release mechanisms of this type are disclosed in U.S. Pat. Nos. 1,294,876, 1,378,574, 2,686,479 and South African Pat. No. 85/7110. In a second type of latch arrangement the release mechanisms are located on the underside of the hoppers where they are positioned to engage release structure which is located between or at ground level alongside, the hopper tracks. Examples of these are disclosed in U.S. Pat. Nos. 1,266,630, 1,333,947 and 4,339,222. A first problem with all of the latch arrangements which are disclosed in the above patents is that the hook and catch formations wear fairly rapidly in use due to the large frictional forces imposed on them by the loads against which they have to operate. In underground mining operations the hoppers are, in many mines, loaded with material which contains a high percentage of abrasive slurry which inevitably finds its way onto and into all of the movable mechanisms on the hopper considerably to aggrevate the wear of the above latch components. The latch components when worn firstly do not positively close the hopper doors which then allow the slurry, including what could be highly valuable ore fines, to dribble from the hoppers and secondly and more importantly cause the doors to unlatch unintentionally when the hoppers are banged and jarred in normal tramming operations. Another problem with most of the latch release mechanisms and particularly those which are activated by release arrangements between or adjacent the hopper tracks is accidental discharge of the hoppers when the latch releases are activated by objects such as logs or chunks of rock or coal which are situated between or alongside the hopper tracks. Accidental dsicharge of a hopper, particularly the larger five to eight tonne hoppers causes serious, expensive and often dangerous disruption of mine production as it is no simple task in the confined space of a mine haulage, to clear the hopper track of the disabled hopper and its partially discharged load.

To minimize this problem great care is taken in most mines to ensure that hopper locking arrangements are of a type which will ensure positive locking of the doors even when the latch components become worn or distorted by accidental damage and also that the latch release mechanisms are so positioned on the hoppers that they are well clear of anything between or alongside the hopper tracks which may cause accidental actuation of the door release mechanisms.

In high speed haulages the accidental discharge problem is often compounded by derailment of not only the discharged hopper but also of the hoppers close to it in the train. In many accidents of this type the derailed hoppers have injured mine personnel and seriously damaged mine services located on the haulage walls.

OBJECT OF THE INVENTION

It is the object of the invention to provide a hopper which includes a door latch and release mechanism which minimizes the accidental discharge problem mentioned above.

SUMMARY OF THE INVENTION

A hopper according to the invention includes a container body which has a discharge opening in its underside, two doors which are pivotally connected to the body on opposite sides of its discharge opening with the pivot axis of the doors lying in the direction of travel of the hopper, the doors being movable between a first position in which they close the opening and a second position in which the opening is open, a door latch arrangement including an abutment formation on each door at one end of the hopper which, in the first position of the doors, are opposite and directed towards each other at a position above the pivot axis of the doors, a detent between the arm abutments for preventing movement of the doors from their first to second positions and means on the hopper body which is movable independently of the doors for moving the detent from between the abutments to enable the doors to move under gravity from their first to their second position.

Further according to the invention one door of the hopper includes a catch which is positioned to engage and lift the other door when the door including the catch is moved from its second to its first position.

Still further according to the invention the door including the catch carries a fixed formation which projects outwardly from the door to the side of the hopper body for engaging a ramp adjacent the hopper path as the hopper is moved past it to lift the door from its second to its first position.

The detent conveniently includes two rollers against each of which an abutment formation on a door abuts in the first position of the doors. The rollers are preferably in contact with each other so that the load on one door is, in the first position of the doors, transferred from its abutment formation on the opposite side of the rollers so that the loads on the doors in use counteract each other to hold the doors in their first position.

In one form of the invention the detent is located on an arm which is pivotally connected to the hopper body on one side of the operative position of the detent and extends to and beyond the side of the hopper body where a formation on the arm is positioned to engage a ramp adjacent the hopper path as the hopper is moved past it to lift the arm and so the detent from between the door abutment formations to enable the doors to move to their second position.

Preferably, the hopper includes the latch arrangement on the doors at each end of the hopper and a lifting beam which joins the free ends of the detent arms and carries the ramp engaging formation.

BRIEF DESCRIPTION OF THE DRAWING

An embodiment of the invention is now described by way of example only with reference to the drawings in which.

DETAILED DESCRIPTION OF THE PREFERRED EMBODIMENT

Figure 1:
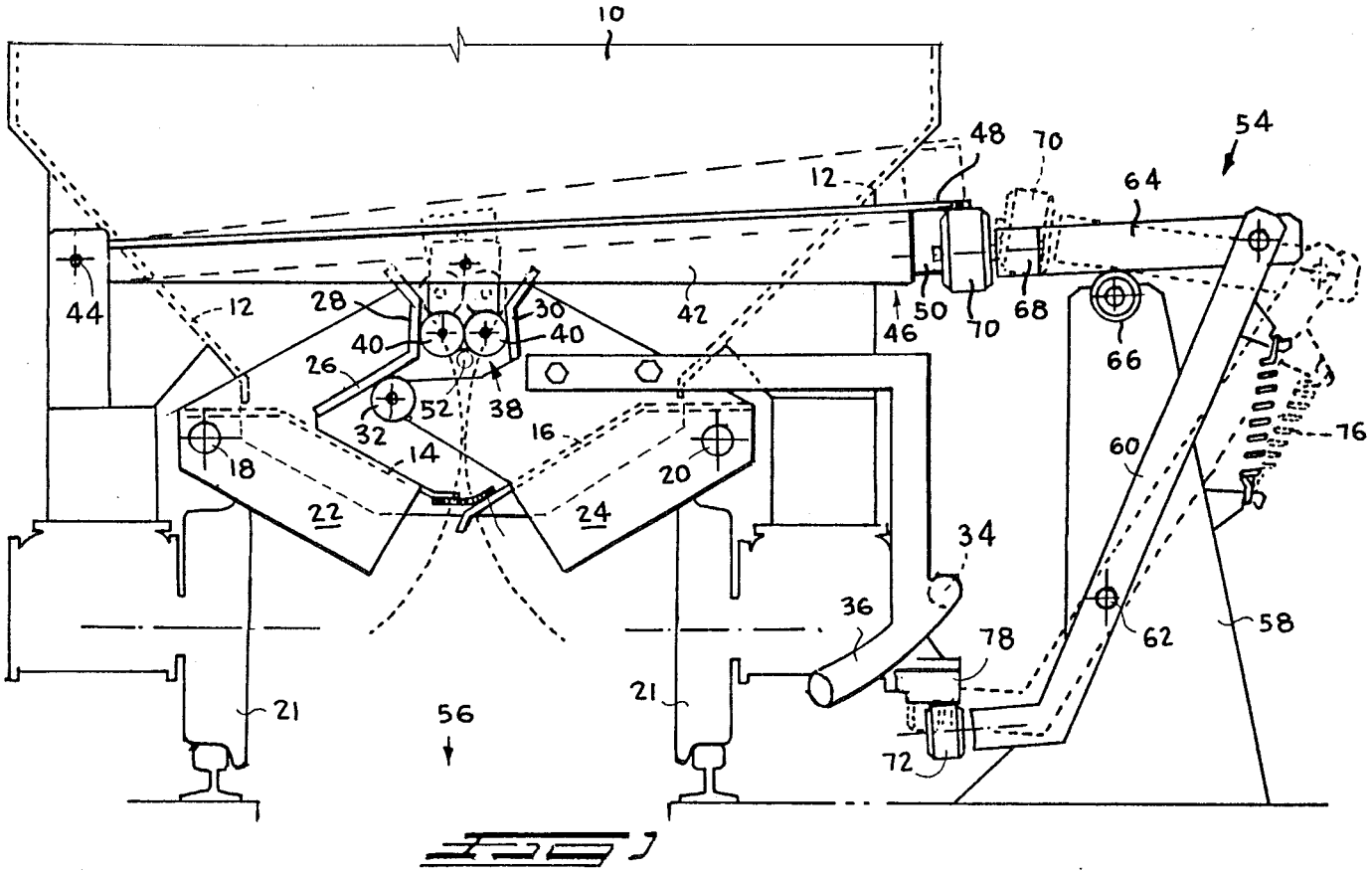
FIG. 1 is a partially schematic end elevation of the hopper of the invention shown with its discharge doors in their closed position.

The hopper of the invention is shown in the drawing to consist of a hopper body 10 which has a discharge opening in its underside between tapering side walls 12, and two doors 14 and 16 which are movable on pivots 18 and 20 on either side of the body opening. The axes of the pivots 18 and 20 lie in the direction of travel of the hopper. The doors 14 and 16 each has a first position in which the opening is closed and a second position in which the opening is open. The hopper body is mounted on a chassis which carries rail wheels 21. The long edge of the door 14 carries a rubber or like door seal 17.

Figure 2:
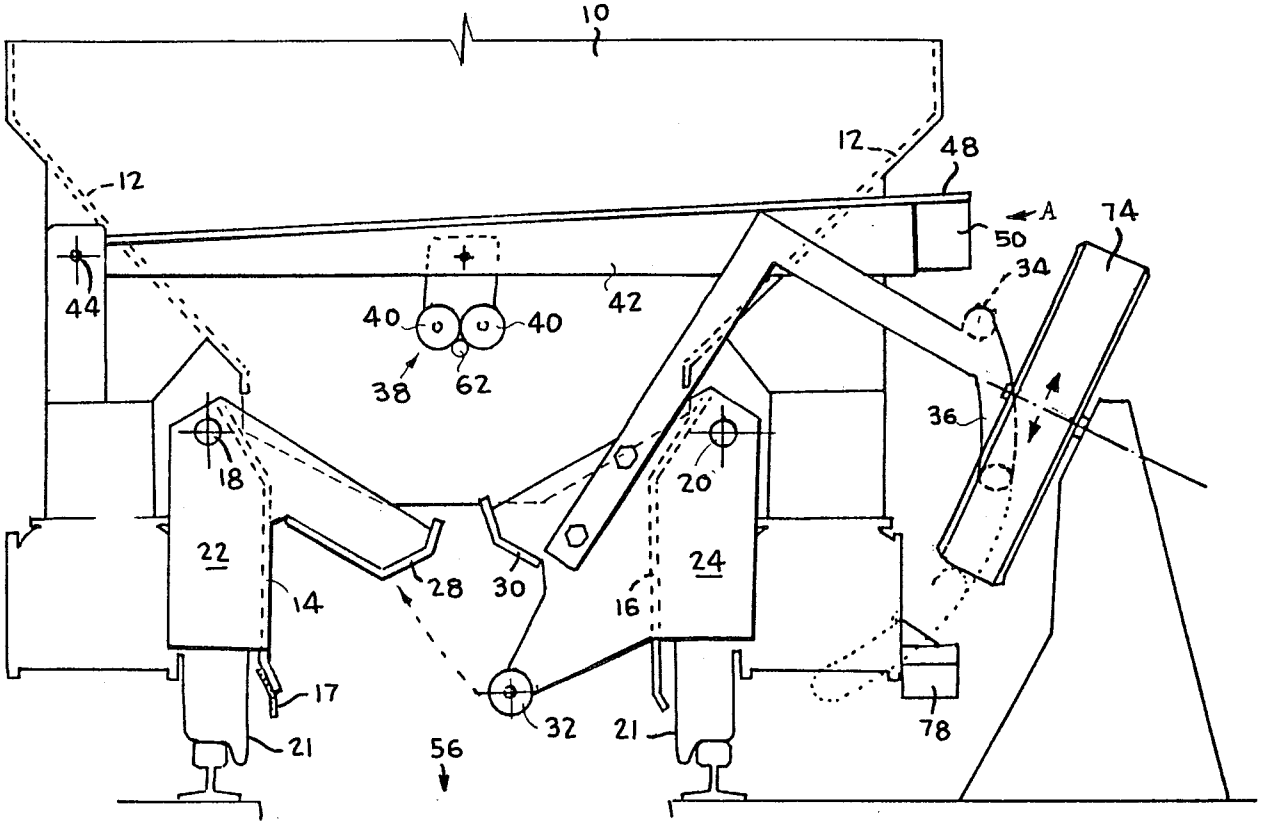
FIG. 2 is a similar view to that of FIG. 1 but with the doors open.

The doors, at both ends of the hopper, each carries a latch arrangement, including side plates 22 and 24 which are fixed to the edges of the doors. The side plates are each shaped as shown in the drawings with the plates 22 on the door 14 carrying edge cam strips 26 which run into vertical abutment formations 28. The plates 24 on the door 16 carry edge abutment formations 30 and rollers 32 which bear on the cam strips 26 on the plates 22 of the door 14. In the closed position of doors 14 and 16 (see (FIG. 1) abutment formations 28 and 30 are opposite and directed toward each other, and are above the pivots 18 and 20. The door 16 additionally carries a low level cam bar 34. The bar 34 extends in a straight line over the length of the hopper body with both of its ends 36 being inwardly and downwardly directed as shown in FIGS. 1 and 2. Detents 38, in the closed position of the doors, as illustrated in FIG. 1, are located between the abutment formations 28 and 30 on the door end plates and each carries two rollers 40 against which the abutment formations bear in the closed position of the doors. The rollers 40 are freely rotatable and in slight pressure contact so that one roller will be rotated by rotation of the other. The detents 38 are located on arms 42 which are pivotally connected to the end walls of the hopper body at 44. The free ends 46 of the arms 42 are bridged by a lifting beam 48 which is more clearly seen in FIG. 3. The lifting beam carries two cam or bridge shaped formations 50. Downward movement of the detents 38 is limited to the position shown in the drawings by stops 52 which are fixed to and project from the end walls of the hopper body.

Figures 3, 4:
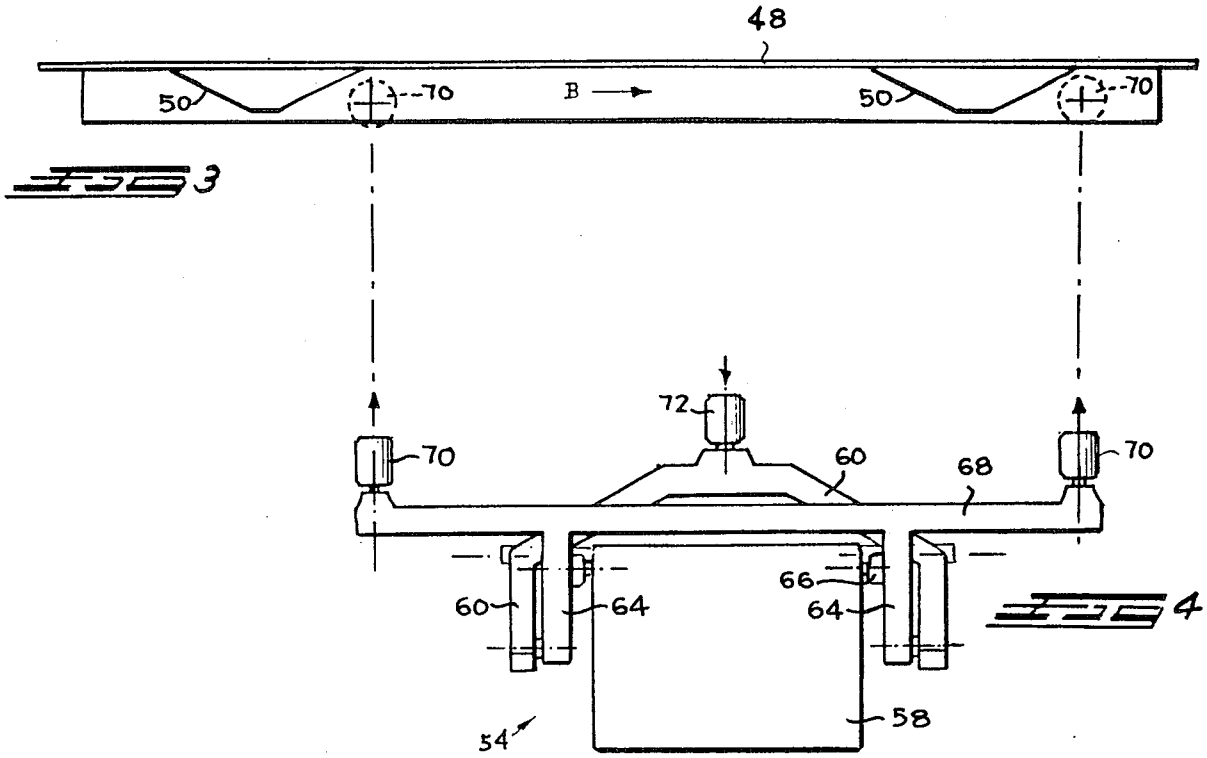
FIGS. 3 and 4 are respectively a side elevation of the hopper detent lifting beam as seen in the direction of the arrow A in FIG. 2 and a plan view of the trackside door operating arrangement shown in FIG. 1.

A latch tripping arrangement 54 is positioned alongside the hopper tracks at a tip 56 into which the hoppers of a train are to discharge their loads. The tripping arrangement 54 consists of a fixed pedestal 58, a yoke 60 which is pivotally connected at 62 to the pedestal, a pair of arms 64 which are pivotally connected to the upper ends of the yoke arms and rest on rollers 66 which are journalled for rotation on the pedestal, a cross member 68 which joins the free ends of the arms 64, rollers 70 which project from the cross member 68 and a roller 72 which projects from the base of the yoke 60 between the rollers 70 as shown in FIG. 4. The movable arms of the tripping arrangement are biased by a spring 76 to the position shown in dotted lines in FIG. 1. A roller 74 is situated alongside the hopper track at or just beyond the end of the tip 56. A roller 74 may be located at each end of the tip where hopper travel through the tip is in both directions.

In use, the ore load in the loaded body bears on the sidewall portions 12 and on the doors 14 and 16 of the hopper body. The load on the doors cause the abutment formations 28 and 30 to tend to rotate towards each other and so to bear heavily on the detent rollers which transfer the load from one door to the other to hold the doors firmly shut against the load. The loaded hopper, which is of course only one of a train, enters the tip and a cam 78, which is an elongated version of the cams 50 on the lifting beam 48 and which is fixed to the hopper chassis at the position shown in FIGS. 1 and 2, runs up against the roller 72 of the tripping arrangement 54. The roller 72 is depressed, against the bias of the spring 76, by the cam from the dotted line position in FIG. 1 to the solid line position to press the rollers 70 into position under the lifting beam 48, as illustrated in FIG. 3. The beam 48 in FIG. 3 is, if viewed with FIG. 4, in practice rotated through 90 degrees and has been illustated in side view and not plan, as it should be, only for clarity of illustration. As the hopper now progresses in the direction of the arrow B, in FIG. 3 the rollers 70 engage the cams 50 and lift the lifting beam 48 to the dotted line position in FIG. 1. The length of the lower surface of the cam 78 must naturally be long enough to enable the rollers 70 to engage and lift the cams when the rollers are clear of the cams they are retracted from under the beam 48 by the spring 76. The purpose of providing two of the rollers 70 and cams 50 is to lift the beam evenly without skewing and so jamming against the load on the detents on the arms 42 at the ends of the hopper body. As the beam is lifted the detents 38 are withdrawn upwardly from between the door abutment formations 28 and 30. When the detents are clear of the buttress formations there is no further restraint on the doors which open instantly and cleanly under gravity. As the doors pivot from their closed position to open position to the abutment formations drop clear of each other following the arcuate dotted lines in FIG. 1. With the doors open and downwardly depending as seen in FIG. 2 the cam bar 34 which is attached to the door 16 is displaced to the FIG. 2 position. When the hopper leaves the tip the leading end 36 of the cam bar engages the ramp or roller 74 which, by camming action, moves the bar downwardly and to the left to move the door 16 back to its closed position as shown in FIG. 1. The roller 74 is resiliently mounted on its stand to minimize the possibility of the roller tipping the hopper when empty. The rollers 32, in their upward path as the door is being closed, engage the cam strips 26 on the door 14 and lifts them and the door 14 back to its closed position with the door 16. The detents 38 and their arms 42 have in the meantime, as soon as the cams on the bar 48 have cleared the rollers 70, dropped back under gravity to the solid line position in the drawings. In their upward path from the FIG. 2 to the FIG. 1 position the outwardly flared upper ends of the abutment formations 28 and 30 follow the dotted paths in FIG. 1 which intersect and move the rollers 40 and the detents upwardly until the doors are almost in the FIG. 1 position. When the abutment formations 287 and 30 are in the FIG. 1 position of the doors, the detents drop under gravity into position between the abutment formations which again lock against the rollers 40 when the cam bar 34 is clear of the roller.

As is clear from the above description and drawings, the door latch arrangement is as positive as it can be and there is little if any possibility of the doors 14 and 16 becoming accidentally unlatched due to wear of the components 28, 30 and 40. Additionally, the height of the detent lifting bar 48 above ground level and the fact that the cams 50 are as close to the side of the hopper body as possible minimises, to a large extent, the possibility of accidental tripping of the detents by contact of the bar with stray objects in the haulageway.

I claim:

1. A hopper including a hopper body which has a discharge opening in its underside, two doors which are pivotally connected to the body on opposite sides of its discharge opening with the pivot axes of the doors lying in the direction of travel of the hopper, the doors being movable between a first position in which they close the opening and a second position in which the opening is open, a door latch arrangement including an abutment formation on each door at one end of the hopper which, in the first position of the doors, are opposite and directed towards each other at a position above the pivot axes of the doors, a detent between the abutments for preventing movement of the doors from their first to second positions, and means on the hopper body movable independently of the doors for moving the detent from between the abutments to enable the doors to move under gravity from their first to their second position.

2. A hopper as claimed in claim 1 in which one door includes means for engaging and lifting the other door when said one door is moved from its second to its first position.

3. A hopper as claimed in claim 2 in which said one door carries means which project outwardly from the one door to the side of the hopper body for engaging a ramp adjacent the hopper path as the hopper is moved past it to lift the one door from its second to its first position.

4. A hopper as claimed in claim 1, said detent comprising two rollers, an abutment formation on each said door abutting a said roller in the first position of the doors.

5. A hopper as claimed in claim 4, said detent rollers being in contact with each other, so that the load on one door is, in the first position of the doors, transferred from the abutment formation thereof through the detent rollers to the other door abutment formation on the opposite side of the rollers so that the loads on the doors in use counteract each other to hold the doors in their first position.

6. A hopper as claimed in claim 1, said means comprising a detent arm pivotally connected at one end to the hopper body on one side of the operative position of the detent and having the other, free and extending to and beyond the side of the hopper body, a formation on the other, free end of said arm positioned to engage a ramp adjacent the hopper path as the hoper is moved past it to lift the arm and the detent to move the detent from between the door abutment formations to enable the doors to move to their second position.

7. A hopper as claimed in claim 6, and further including a second said door latch arrangement on the doors at the opposite ends thereof from said first mentioned door latch arrangement, and a lifting beam joining the free ends of the detent arms, said lifting beam carrying the ramp engaging formation.

8. A hopper as claimed in claim 1, wherein the lifting beam carries two ramp engaging formations which are close to and equally spaced from the ends of the beam, so that the two formations will simultaneously engage a beam lifting ramp situated adjacent the hopper path to lift the beam evenly from both ends.

* * * * *